US005227696A

United States Patent [19]

Asars

[11] Patent Number: 5,227,696

[45] Date of Patent: Jul. 13, 1993

[54] POWER SAVER CIRCUIT FOR TFEL EDGE EMITTER DEVICE

[75] Inventor: Juris A. Asars, Murrysville, Pa.

[73] Assignee: Westinghouse Electric Corp., Pittsburgh, Pa.

[21] Appl. No.: 874,862

[22] Filed: Apr. 28, 1992

[51] Int. Cl.[5] ..... G09G 3/10; G09G 3/30

[52] U.S. Cl. ..... 315/169.3; 340/781

[58] Field of Search ..... 315/169.1, 169.3, 173, 315/227 R, 228, 240, 241 R, 244; 340/781

[56] References Cited

U.S. PATENT DOCUMENTS

| | | | |
|---|---|---|---|
| 4,070,663 | 1/1978 | Kanatani et al. | 340/324 |
| 4,535,341 | 8/1985 | Kun et al. | 346/107 |
| 4,707,692 | 11/1987 | Higgins et al. | 340/805 |
| 4,733,228 | 3/1988 | Fiegal | 340/719 |
| 4,734,723 | 3/1988 | Ishitobi | 346/160 |
| 4,823,121 | 4/1989 | Sakamoto et al. | 340/781 |
| 4,899,184 | 2/1990 | Leksell et al. | 346/155 |
| 4,922,243 | 5/1990 | Kozicki et al. | 340/813 |
| 4,954,752 | 9/1990 | Young et al. | 315/169 |
| 4,958,105 | 9/1990 | Young et al. | 315/169 |
| 5,095,248 | 3/1992 | Sato | 315/169.3 |

*Primary Examiner*—Steven Mottola
*Attorney, Agent, or Firm*—T. H. Martin

[57] ABSTRACT

An improved power saving drive circuit is provided for a multiplexed thin film electroluminescent (TFEL) array having a number of edge emitter devices. The drive circuit includes a charge circuit and a discharge circuit operatively connected to a load capacitance. Although the charge and discharge circuits may contain common elements, the discharge circuit usually has fewer windings than the charge circuit. A voltage regulator is provided to maintain the voltage on the load capacitor during the interval between charging and discharging thereof.

10 Claims, 2 Drawing Sheets

POWER SAVER CIRCUIT FOR TFEL EDGE EMITTER DEVICE

BACKGROUND OF THE INVENTION

1. Field of the Invention

The present invention is directed generally to the field of drive circuits and more specifically to drive circuits for thin film electroluminescent (TFEL) edge emitter devices.

2. Description of the Prior Art

It is well known that electroluminescent devices generally, and, particularly, thin film electroluminescent edge emitting devices, may be utilized to provide an electronically controlled, high resolution light source. TFEL elements emit light when a changing electric field is present across the element. Examples of the structures of TFEL elements are found in U.S. Pat. No. 4,535,341, U.S. Pat. No. 4,734,723, and U.S. Pat. No. 4,899,184.

TFEL edge emitter devices are typically configured in arrays utilizing multiplexed common drive circuitry to control many TFEL devices from a single source. A common driver circuit is typically used to generate the peak-to peak voltage necessary to illuminate the TFEL edge emitter device, and a demultiplexing circuit that directs the signal to the individual devices as desired.

TFEL devices require large operating voltages on the order of five hundred volts peak-to-peak. Not only is a high voltage required for operating the device, but the voltage must be precisely regulated to obtain consistent and reproducible light emission from the TFEL device. Traditionally, the common driver circuits use current steering transistors to charge the capacitive TFEL load. The voltage stored in the TFEL load is then discharged by dissipating the power through resistive circuitry.

More recently, a more efficient common drive circuit has been developed which comprises a bidirectional switch for selectively connecting an individual pixel terminal to a source of voltage through an inductance thereby enabling current to flow into the pixel to charge the pixel to an operating voltage and enable current to flow out of the pixel back to the source of voltage when the pulse is terminated. A transformer has a primary winding connected between the first terminal and the bidirectional switch for enabling the pixel to charge to an operating voltage, and a secondary control winding connected in series with a diode across the source voltage and ground for limiting the value of that operating voltage. The bidirectional switch is operated so that a substantial portion of the energy used to charge the pixel is returned to the source of voltage at the end of the pulse duration. The reader desiring more information concerning the construction and operation of the aforementioned drive circuit is directed to U.S. Pat. application Ser. No. 412,241 filed Sep. 25, 1989, and assigned to the same assignee as the present invention, which is hereby incorporated by reference.

Experimental evaluation of the most recent power saver circuit points out two potential problem areas. First, the voltage of the pulse tends to droop during the duration of the pulse. The droop in pulse amplitude following the leading edge of the pulse may produce non-uniform pixel excitation in the presence of significant common bus resistance. This is caused by discharge of the load capacitance through the currently utilized commutator level shifter and by the resistance component of the pixel impedance. Second, the duration of the trailing edge of the pulse when compared to the duration of the leading leading edge of the pulse may be too long in order to achieve optimum performance. There is a need for an improved power saving circuit that will rectify these problems existing in power saver circuits.

SUMMARY OF THE INVENTION

The present invention is directed to an improved power saving voltage drive circuit for a TFEL edge emitter device of the type having a plurality of pixels. A holding capacitor is provided in the power saver circuit to hold the voltage of the pulse relatively constant throughout its duration.

In the present power saving voltage drive circuit, the emitter common terminals or load capacitances are connected to a potential equal to the desired peak amplitude during the time between the leading and trailing edges of the pulses. This prevents droop in the pulse amplitude during the time between the charging and discharging of the load capacitance and eliminates the need for a control winding on the inductor. This potential can be obtained from an external source or, preferably, stored on a holding voltage capacitor which can be replenished by the leading edge of the pulse.

The power saving drive circuit includes a load capacitance means which enables each pixel to charge to a desired voltage related to the pixel operating voltage. A load capacitance discharge means enables the load capacitance means to discharge its stored voltage. The load capacitance charge means and load capacitance discharge means operate through different circuits. A voltage regulation means is provided to maintain the load capacitance voltage during the interval between charging and discharging.

The improved power saver circuit is characterized by using a different number of turns for the load capacitance charging circuit and the load capacitance discharging circuit. These different numbers of turns produce different inductances and permit the durations of the leading edge slope and trailing edge slope to be selected independently. Thus, the duration of the trailing edge of the pulse can be adjusted independently of the duration of the leading edge of the pulse, thereby allowing the circuit to achieve optimum performance.

BRIEF DESCRIPTION OF THE DRAWINGS

FIG. 3A shows the status of switch 14. FIG. 3B shows the status of switch 20. FIG. 3C shows the status of switch 32. FIG. 3D shows the status of switch 22. FIG. 3E indicates the time interval during which a typical group of pixels are selected for the charging and discharging process.

DESCRIPTION OF THE PREFERRED EMBODIMENT

Figure 1:
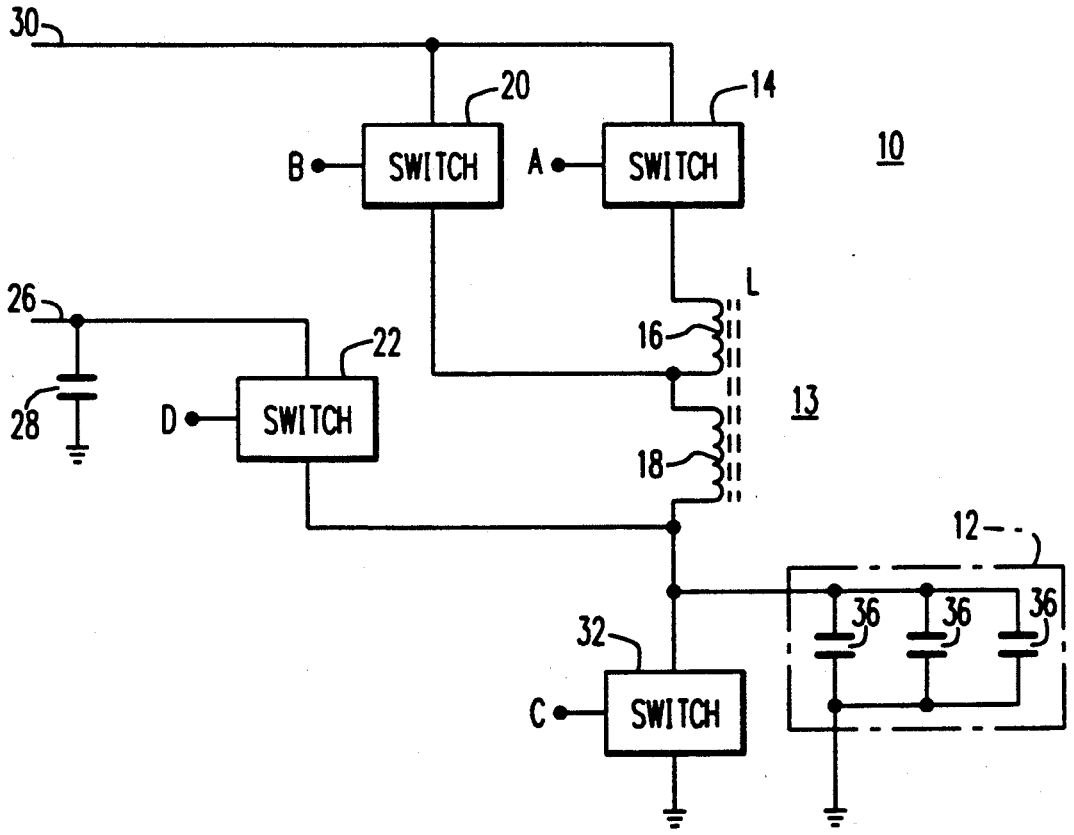
FIG. 1 is a schematic representation of the improved power saver circuit of the present invention.

FIG. 1 is a schematic representation of the improved power saver circuit of the present invention. In FIG. 1, improved power circuit 10 for a load capacitance 12 is provided with separate load capacitance charging and discharging circuits. A different number of turns in the inductor 13 of the charging circuit and discharging circuit are provided.

The load capacitance charging circuit comprises switch 14 which sends current through windings 16 and 18 to charge the load capacitance 12. In the load capacitance discharging circuit, switch 20 directs current only through winding 18. Switch 22 connects load capacitance 12 to a regulated voltage at 26. This regulated voltage is equal to the desired peak amplitude during the time between the leading edge and trailing edge of the charging and discharging circuits. The potential can be obtained from an external source 26 or, alternatively, stored on a voltage regulating or holding capacitor 28 which may be replenished by the leading edge of the pulse. The amplitude of the pulse is regulated by supplying the stored potential to the voltage regulator circuit that determines the value of the primary charging voltage source 30. The operation of the circuitry in FIG. 1 will be described in combination with FIG. 2 and FIGS. 3A-3E.

Figure 3A:
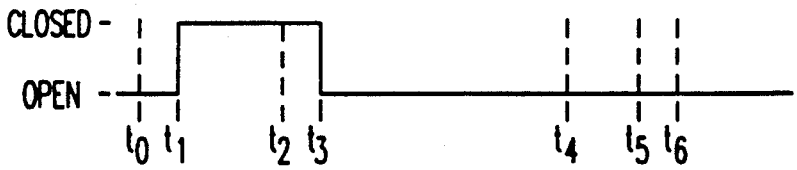
FIGS. 3A through 3E illustrate various signals helpful in understanding the operation of the circuit illustrated in FIG. 1.
Figure 3B:
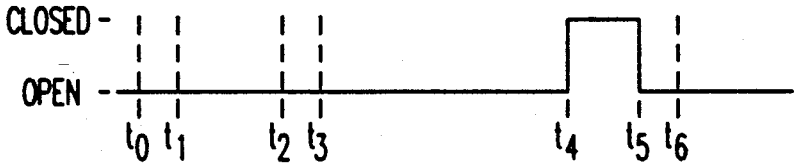
Figure 3C:
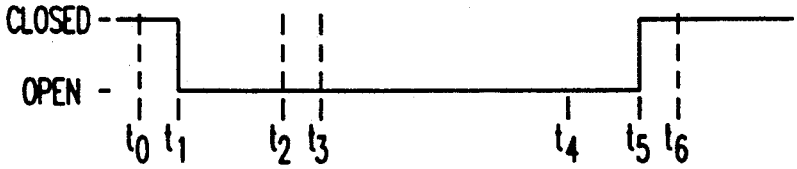
Figure 3D:
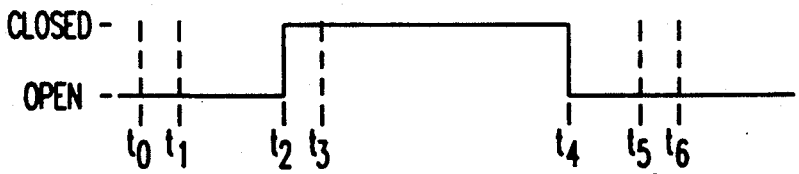
Figure 3E:
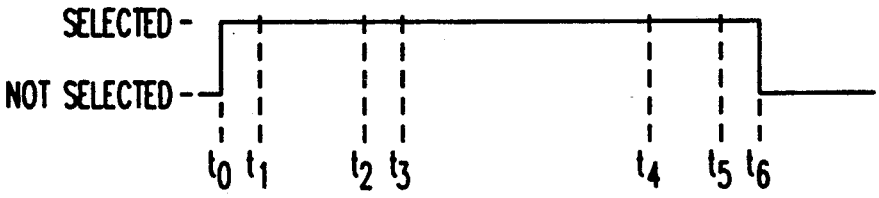

At time $t_0$, when a particular group of pixels or load capacitance 12 is selected as indicated by FIG. 3E, switches 14, 20 and 22, as shown by FIGS. 3A, 3B and 3D, respectively, are turned off or open while switch 32 remains on or closed as shown by FIG. 3C to discharge all residual charge from load capacitance 12.

At time $t_1$, switch 32 is opened as shown by FIG. 3C and switch 14 is closed as shown by FIG. 3A. Current from external source 30 through windings 16 and 18 to charge the load capacitance 12. At time $t_2$, or as load capacitor potential v36 in FIG. 2 reaches that of constant potential source 26, switch 22 is turned on or closed as shown by FIG. 3D. Residual energy in inductor 13 flows into source 26 or holding capacitor 28. This establishes and holds steady the pulse amplitude of $v_{36}$ in FIG. 2 after switch 14 is opened at time $t_3$ as shown by FIG. 3A. Switch 14 is opened or turned off at time $t_3$ when current flow from source 30 through inductor 13 goes to zero and before it reverses direction. The holding voltage at 26 can be supplied from an external source or the holding capacitor 28 can be charged by the leading edge of the pulses between times $t_2$ and $t_3$ in FIG. 3 with voltage stored on capacitor 28 used to regulate voltage source 30 in order to achieve the desired pulse amplitude.

Figure 2:
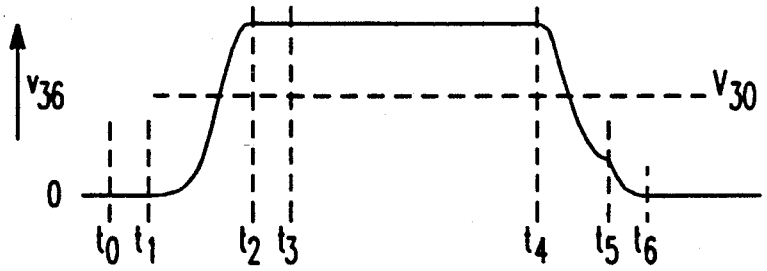
FIG. 2 is an illustration of the voltage signal of the load capacitance of the circuit illustrated in FIG. 1.

At time $t_4$, switch 22 is opened or turned off as shown by FIG. 3D and switch 20 is turned on or closed as shown in FIG. 3B. At this time, load capacitance 12 is discharged with current flowing from load capacitor 12 through inductor winding 18 back into energy source 30. As this discharge current goes to zero at time $t_5$, switch 20 is turned off or opened as shown in FIG. 3B and switch 32 is closed or turned on as shown in FIG. 3C. Switch 32 discharges the residual charge on load capacitor 12 to ground or zero as shown in FIG. 2. Alternatively, the discharging circuit can be connected through an independent inductor (not shown) or discharge to other (not shown) than energy source 30 current receptor maintained at a lower voltage than source 30 to reduce the level of residual charge left on load capacitor 12 at time $t_5$ in FIG. 3.

At time $t_6$, the particular group of pixels or load capacitance 12 is deselected as shown in FIG. 3E. All switches have been returned to the same state as at $t_0$ and a new group of pixels or load capacitance can be selected.

Switches 14, 20, 22 and 32 can be MOCT switches which are insulated gate field effect transistors.

As shown in FIG. 2, power saver circuit device only provides a positive pulse. For a negative pulse, a separate oppositely arranged power saver circuit (not shown) is provided. Such a circuit is adapted to provide a series of negative pulses in accordance with the practice of the invention with regard to the positive pulses. An advantage obtained by providing separate negative and positive pulse circuits is the need of the circuit devices only to withstand peak voltages rather than peak to peak voltages.

An important feature of the present invention is the ability to regulate the voltage of the pulses. The regulation of the voltage is accomplished independent of the load. Through connection either to external voltage regulation source 26 or voltage regulating capacitor 28, voltage droop between time periods $t_3$ and $t_4$ is prevented. It also eliminates the need for a control winding on the inductor. Voltage regulating or holding capacitor 28 is capable of holding the voltage of the pulses constant because the capacitance of voltage regulating capacitor 28 is much larger than the load capacitor 12.

Another important feature of the present invention is the provision of a different number of inductor turns for the load capacitance charging and discharging circuits. Because of these different number of turns, the slope of the leading edge charging pulse and trailing edge discharging pulse can be selected independently. This permits the duration of the trailing edge to be shortened to achieve optimum performance. In a typical example, winding 16 may have 8 turns whereas winding 18 has twenty turns. In this event, the load capacitance charging circuit proceeds through the combined 28 turns of windings 16 and 18 whereas the load capacitance discharging circuit passes on)y through the 20 turns of winding 18.

Because a number of pulses are required for the voltage regulator circuit to initially reach a stable equilibrium, the common driver must be activated before printing starts at the top of a page. In addition, parttime activity of the common driver circuit 10 may be required during blank spaces between character lines to keep voltage regulating capacitor 28 charged and the voltage regulator circuit stable. Optimization of the values of capacitors 28 and 36 shown on FIG. 1 as well as the response speed of the regulator circuit should minimize this disadvantage.

While I have described a present preferred embodiment of the invention, it is to be distinctly understood that the invention is not limited thereto but may be otherwise embodied and practiced within the scope of the following claims.

I claim:

1. A power saving drive circuit for a multiplexed thin film electroluminescent (TFEL) array having a plurality of TFEL edge emitter devices, each device having a plurality of pixels, each pixel of each device having a first terminal and sharing a common second terminal with the other pixels of that device comprising:

a. charge means to enable to pixel on a selected device to charge to an operating voltage;

b. load capacitance means to store said operating voltage;

c. discharge means to enable said load capacitance means to discharge its stored voltage; and d. voltage regulating means to maintain said load capacitance means operating voltage between the charging and discharging of said load capacitance means.

2. A power saving drive circuit for a multiplexed thin film electroluminescent (TFEL) array having a plurality of TFEL edge emitter devices, each device having a plurality of pixels, each pixel of each device having a first terminal and sharing a common second terminal with the other pixels of that device comprising:

a. charge means to enable to pixel on a selected device to charge to an operating voltage said charge means comprising a first circuit, connected to an external voltage source, said first circuit comprising a first winding means;

b. load capacitance means to store said operating voltage;

c. discharge means to enable said load capacitance means to discharge its stored voltage; and d. voltage regulating means to maintain said load capacitance means operating voltage between the charging and discharging of said load capacitance means.

3. The drive circuit of claim 2 wherein said discharge means comprises a second circuit connected to said external voltage source, said second circuit comprising a second winding means, said second winding means having a different number of windings than said first winding means.

4. The drive circuit of claim 1 wherein said voltage regulating means comprises an external voltage source operatively connected to said load capacitance means.

5. The drive circuit of claim 1 wherein said voltage regulating means comprises capacitance means operatively connected to said load capacitance means, said capacitance means being charged by said charge means.

6. The drive circuit of claim 1 further comprising charge dumping means operatively connected to said load capacitance means for discharging excess charge stored on said load capacitance means to ground.

7. A method of delivering power to a thin film electroluminescent (TFEL) edge emitter device of the type having a plurality of pixels, comprising the steps of:

a. charging a load capacitance means from a source of voltage to an operating voltage, said load capacitance means operatively connected to a selected pixel;

b. maintaining said operating voltage charge stored on said load capacitance means; and c. discharging said load capacitance means to return at least a portion of the stored energy to said source of voltage.

8. The method of claim 7 wherein said charge stored on said load capacitance means is maintained by a second external voltage source operatively connected to said load capacitance means.

9. The method of claim 7 wherein said charge stored on said load capacitance means is maintained by a capacitance means operatively connected to said load capacitance means wherein said capacitance means is charged along with said load capacitance means.

10. The method of claim 7 further comprising the step of discharging any excess charge stored on said load capacitance means to ground.

* * * * *